US006018900A

United States Patent [19]

Guede

[11] Patent Number: 6,018,900

[45] Date of Patent: Feb. 1, 2000

[54] SAFETY DEVICE FOR RIFLE TRIGGERS

[75] Inventor: Jose Luis Lameiras Guede, Zamudio-Bilbao, Spain

[73] Assignee: Ardesa, S.A., Zamudio-Bilbao, Spain

[21] Appl. No.: 09/090,897

[22] Filed: Jun. 3, 1998

[51] Int. Cl.[7] ..... F41A 17/00

[52] U.S. Cl. ..... 42/70.06

[58] Field of Search ..... 42/70.06, 70.07, 42/70.08, 65, 105

[56] References Cited

U.S. PATENT DOCUMENTS

| | | | |
|---|---|---|---|
| 4,839,978 | 6/1989 | Lechelle et al. | 42/65 |
| 4,918,850 | 4/1990 | Rick | 42/65 |
| 4,989,357 | 2/1991 | Norman et al. | 42/70.08 |
| 5,149,898 | 9/1992 | Chesnut et al. | 42/69.01 |
| 5,206,445 | 4/1993 | Comley et al. | 42/105 |
| 5,752,338 | 5/1998 | Guede | 42/70.06 |

*Primary Examiner*—Charles T. Jordan
*Assistant Examiner*—Denise J Buckley
*Attorney, Agent, or Firm*—Helfgott & Karas, P.C.

[57] ABSTRACT

The device has an articulated plate (1) which swings about an axis (3) on the trigger mechanism casing (2) when a lever (4) extending therefrom is driven, its opposite end having a knurl (5) through which movement is conveyed to a second swinging plate (6), which receives the movement of the knurl (5) through a slotted hole (7), said plate having a double crank defining a middle stop (10), and being joined to the mechanism casing at its end opposite the slotted hole (7) through an axis or pin (9), which stop (10), depending on the two positions the swinging plate (1) is able to take up, can lie opposite the top end (11) of the trigger (12) or otherwise, causing the same to be locked or otherwise. The articulated plate (1) is at the same time provided with a cranked extension (13) which locks the rifle safety (14) when the stop (10) locks the trigger (12).

3 Claims, 4 Drawing Sheets

A-B

SAFETY DEVICE FOR RIFLE TRIGGERS

OBJECT OF THE INVENTION

The present invention relates to a safety device specifically devised to lock/unlock a rifle trigger in order to prevent the arm from being accidentally or unintentionally fired, which would obviously have unpredictable consequences, which device offers a double safety level because at the same time as the trigger is locked to prevent it from being pressed, the rifle safety is also locked and consequently holds the firing pin back, preventing firing from taking place in contingencies other than when the trigger is unduly pressed, such as when the rifle falls on the ground.

BACKGROUND OF THE INVENTION

Muzzle-loaded rifles usually have a safety position of the bolt which prevents the arm from being accidentally fired, which safety position is achieved by sliding back the relevant bolt handle until the latter is set in an opening above the linear notch for driving the actual bolt.

Said handle may nevertheless be ousted from the safety position whilst carrying or handling the arm, resulting in an accident which may be fatal.

In addition to this safety device for or position of the bolt, certain rifles have a safety device which locks the trigger independently of the locking by the bolt handle.

In this sense, said trigger safety locking device is based upon a plate mounted sideways on one side of the trigger mechanism casing and articulated to said casing, which plate may be driven by means of a lever to be able to take up two positions, namely a trigger locking and a trigger release position.

Now then, although this safety device prevents the arm from being unintentionally fired in most cases if the arm is dropped or unintentionally manipulated, etc., there is no doubt that the device includes a number of internal components that on the one hand render the mechanism extremely complex and on the other prevent same from being sufficiently efficient, for it may fail precisely because the internal elements of the mechanism, ensuring that the trigger is locked, are concealed and the trigger itself needs to be driven in order to check whether or not it is locked.

This same applicant holds a Spanish patent application number 9600206 which describes a safety device for muzzle-loaded rifle triggers fully solving the foregoing drawbacks, providing a structurally simpler and functionally more reliable solution. More specifically, said safety device consists of a plate extending into a manually drivable lever, which plate is mounted to swing on the rifle mechanism casing and is provided on its rear edge with a heel which, depending on the position of said plate, when said lever is driven, lies above the rear edge of the trigger or otherwise, interfering with the operation of such trigger or otherwise. Thus, when the heel of the swinging plate lies above the top edge of the trigger, the latter is unable to swing and firing of the arm is therefore impossible.

DESCRIPTION OF THE INVENTION

The device disclosed herein constitutes a new technological step forward in this field and more specifically a solution which, with reference to the aforesaid patent, provides a structurally simpler, lighter and cheaper mechanism which moreover offers an enhanced safety level.

More specifically and in order to achieve the above, and similarly based upon the use of an articulated plate extending into a manually drivable lever, said plate is provided opposite said lever with a knurl through which it drives a second swinging plate, also mounted to pivot on the trigger mechanism casing, to which end said swinging plate is provided with a slotted hole in which said knurl plays, the foregoing in order that when the articulated plate swings, the swinging plate will inevitably swing at the same time, the latter plate being provided opposite its slotted hole with a double cranked extension, defining a sort of U-shape, the free end of one of its branches being articulated to the mechanism casing, whereas its middle branch constitutes a mobile stop which may lie opposite the top end of the trigger, or otherwise, causing it to be locked or otherwise.

Additionally, and in accordance with another of the characteristics of the invention, the articulated plate, which extends into the manually drivable lever, has in turn been devised to include a cranked extension, which may lock the rifle safety or otherwise, in order that when the stop defined by the swinging plate locks the trigger, said cranked extension of the articulated plate in turn locks the safety, thereby for an enhanced safety level to be achieved, as aforesaid.

Finally, the articulated plate has two holes in which a pin may be selectively inserted to delimit two extreme positions for said articulated plate, namely a safety position in which the trigger and the safety are locked and a firing position in which said elements are free for the arm to be normally operated. Furthermore, when the pin is located in either hole, delimiting the extreme positions, a slight or click sound is produced to warn the user that the arm is in the safety or locked position.

DESCRIPTION OF THE DRAWINGS

In order to provide a fuller description and contribute to the complete understanding of the characteristics of this invention, in accordance with a preferred embodiment thereof, a set of drawings is attached to the specification which, while purely illustrative and not fully comprehensive, shows the following.

PREFERRED EMBODIMENT OF THE INVENTION

Figure 1:
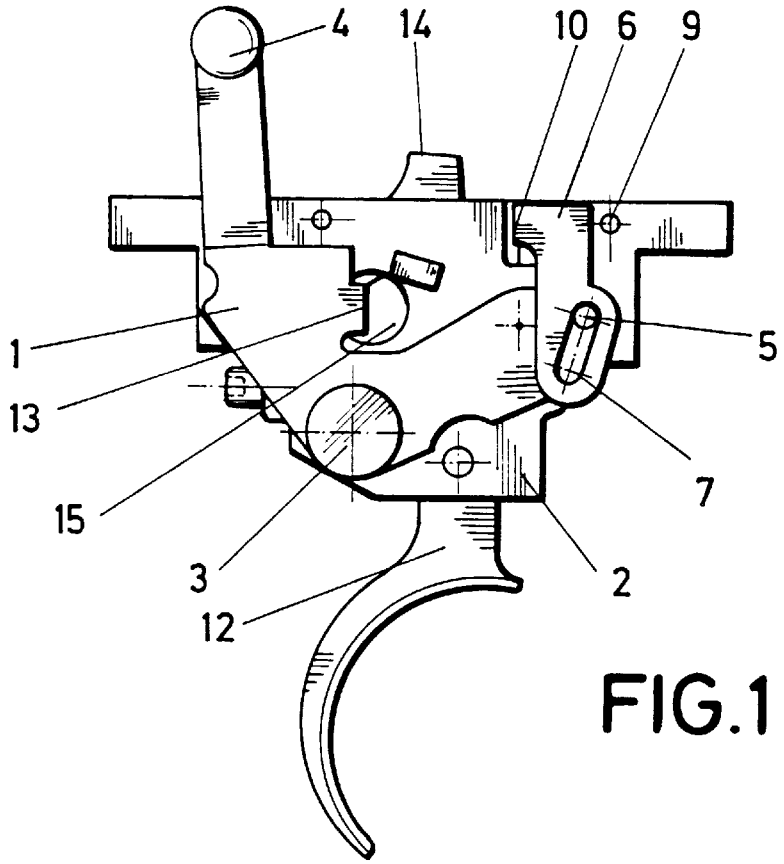
FIG. 1.—Is a side elevation view of a rifle mechanism casing provided with the safety device subject of the present invention, which device is shown in the safety position.
Figure 2:
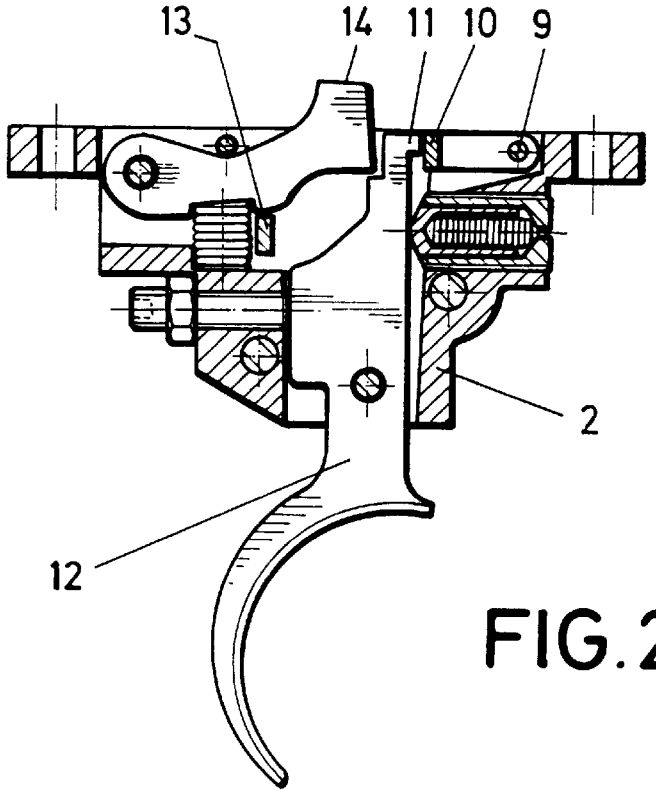
FIG. 2.—Is a longitudinal view of the assembly shown in the preceding figure, at the height of the trigger and the safety and in the same safety position of said figure.
Figure 3:
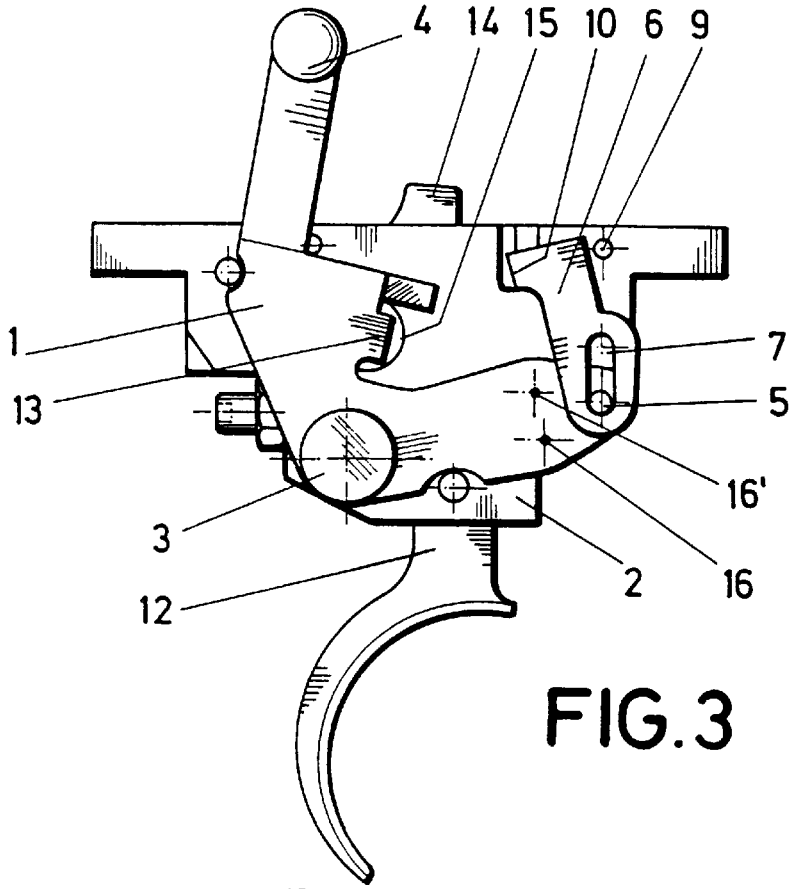
FIGS. 3 and 4.—Are representations similar to those of FIGS. 1 and 2, albeit with the assembly in the firing position.
Figure 4:
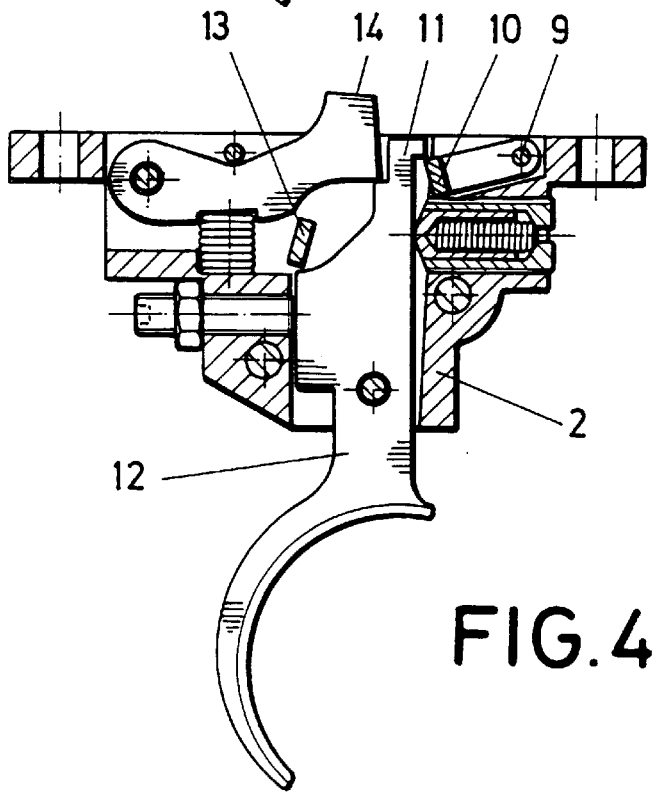

With reference to the figures, the safety device disclosed herein can be seen to consist of an articulated plate (1) mounted to swing on the trigger mechanism casing (2) about an axis (3) located on a lower middle level, which plate (1) extends at the top and through one of its ends into a manually drivable lever (4) which may be reached directly from outside, whereas its opposite end is provided with a knurl (5) through which said articulated plate (I) conveys its movement to a generally U-shaped swinging plate (6), one of its side branches, actually identified with reference numeral (6), being provided with a slotted hole (7) in which said knurl (5) plays, whereas its other side branch, which is considerably narrower and shorter, playing in a slot (8) of the mechanism casing (2), receives the axis (9) to pivot on said mechanism casing, its middle branch (10) constituting a stop which may lie opposite the top end (11) of the trigger (12), as shown in FIGS. 1 and 2, causing it to be locked or held still, or is able to move downwards to allow said trigger to swing, specifically in the position of the assembly shown in FIGS. 3 and 4, in which the manually drivable lever (4) has been moved forwards, the knurl (5) has been swung downwards, forcing the plate (6) to swing and in turn move the stop (10) downwards as well and releasing the trigger (12).

Figure 5:
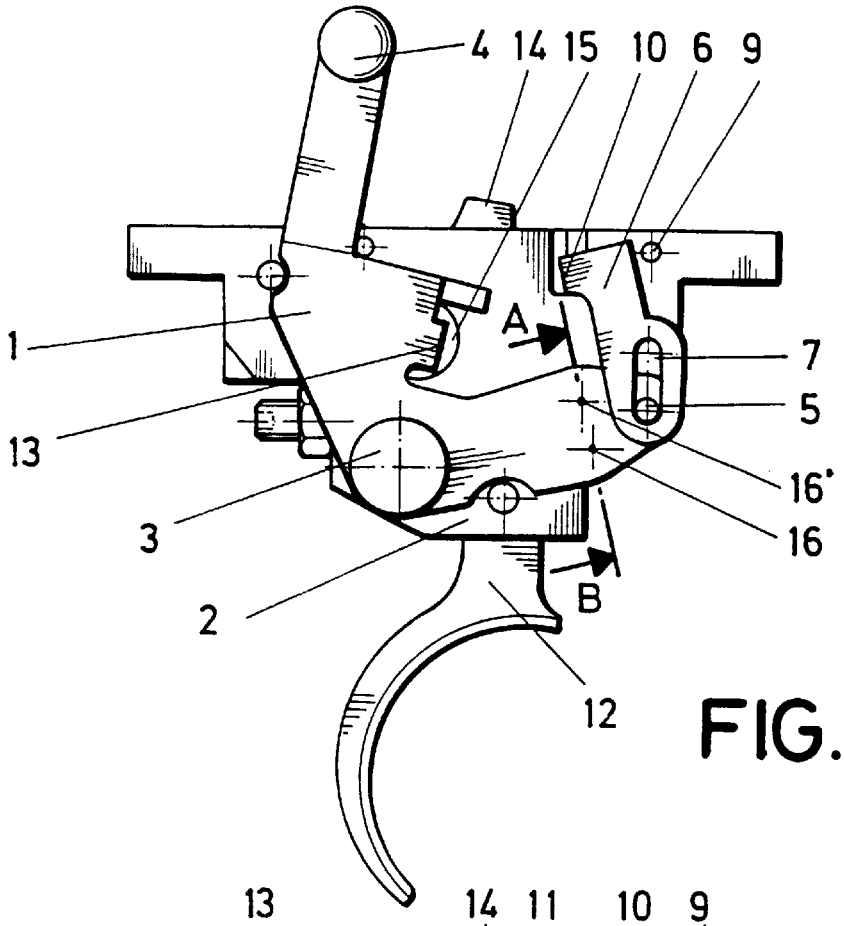
FIGS. 5 and 6.—Are once again representations similar to those of FIGS. 1 and 2, albeit with the mechanism fired.
Figure 6:
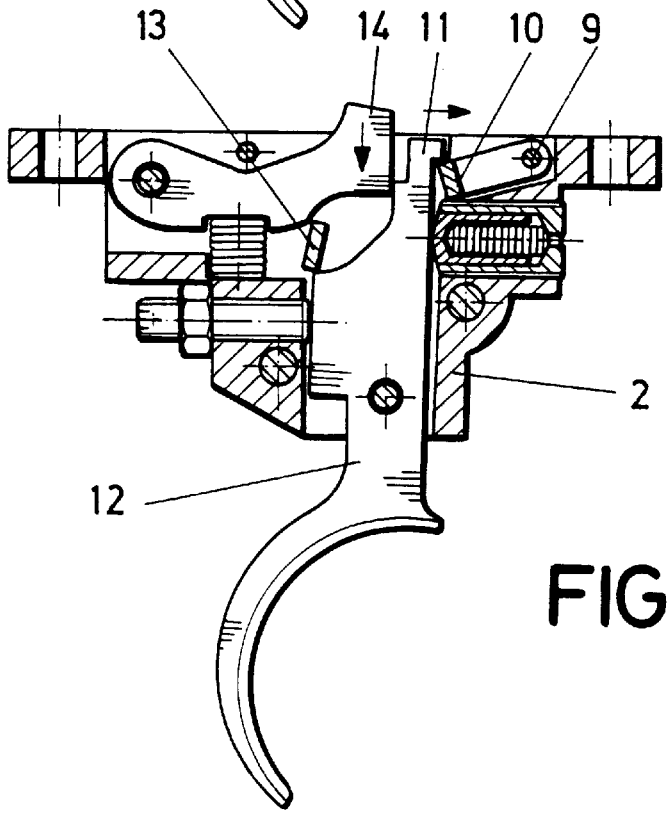

To supplement the above-described structure, the articulated plate (1) is provided with a cranked extension (13) which lies beneath the safety (14), and therefore in the safety position shown in FIGS. (1) and (2), at the same time as the stop (10) of the swinging plate (6) locks the trigger (12), said extension (13) of the articulated plate (1) in turn locks the safety (14), whereas when the assembly takes up the firing position shown in FIGS. 3 and 4, the actual swinging of the articulated plate (1) causes the cranked extension (13) playing within the window (15) of the mechanism casing (2) to move forward, becoming physically detached from the safety (14) and allowing it to move down, which is necessary for the trigger (12) to swing frontally in order for firing to take place, as shown in FIGS. 5 and 6 and more specifically by the latter's arrows.

Figure 7:
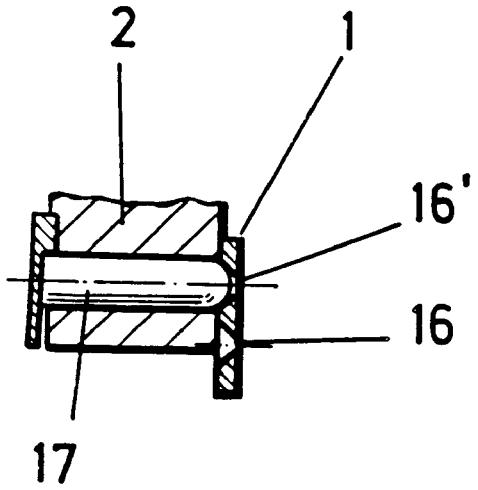
FIG. 7.—Is a close cross-sectional view of the device, at the height of the locking area for its two limiting positions, in accordance with line A–B of FIG. 5.
Figure 8:
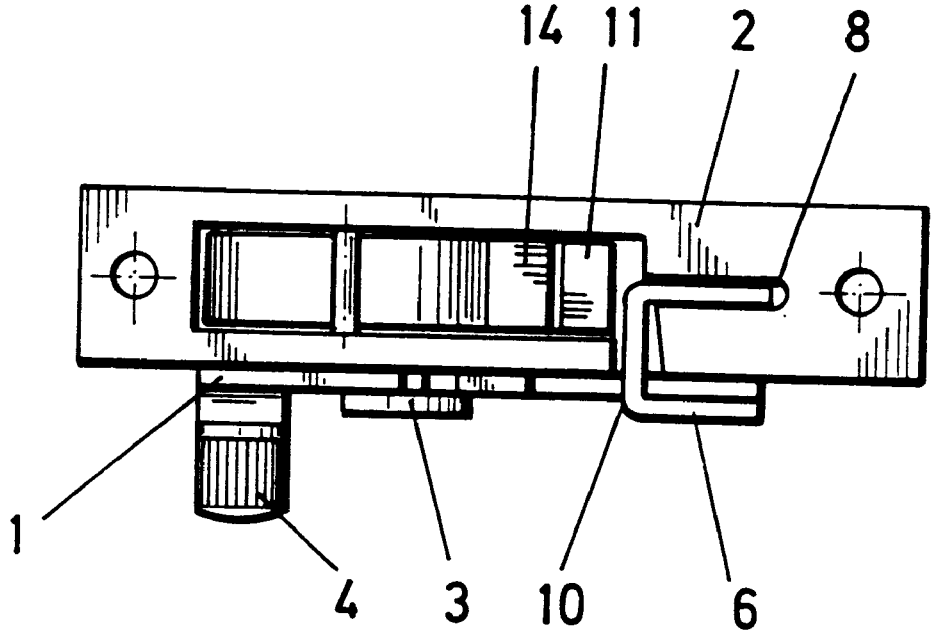
FIG. 8.—Is finally a close plan view of the assembly shown in FIG. 1.

In order for the device to be kept duly stable in the safety position of FIGS. 1 and 2 or in the firing position of FIGS. 3 and 4, the articulated plate (1) is provided relatively close to its knurl (5) with a pair of holes (16–16') working with a retractable pin (17), which is especially visible in the sectional close view of FIG. 7, and hence when the pin (17) is inserted in the hole (16), the mechanism is locked in the safety position, whereas when it is inserted in the hole (16'), said mechanism is locked in the firing position, thereby ensuring stability in both positions.

Furthermore, when the pin (17) is located in either hole (16–16'), delimiting the end positions, a slight or click sound is produced to warn the user that the arm is in the safety or locked position.

I claim:

1. A safety device for rifle triggers, which includes a plate (1) articulated through an axis (3) to the trigger mechanism casing (2), which plate extends into a manually drivable lever (4), which may be reached directly from outside the arm and through which said plate can take up two positions, namely a safety and a firing position, by locking and unlocking the rifle trigger (12), characterised in that said articulated plate (1), whose pivoting axis (3) lies on a lower middle level, is provided at its end opposite the manually drivable lever (4) with a knurl (5) playing in a slotted hole (7) of a second swinging plate (6) provided with a doubly cranked extension, the free end of which is articulated through a cross axis (9) to the mechanism casing (2), its middle sector constituting a slot (10) which, depending on the position of the manually drivable lever (4), lies opposite the top end (11) of the trigger (12) or otherwise, causing it to be locked or otherwise.

2. A safety device for rifle triggers, as in claim 1, characterised in that the articulated plate (1) is in turn provided with a cranked extension (13) playing in a window (15) of the mechanism casing (2) and which in the safety position lies right beneath the rifle safety (14), preventing it from swinging as required for firing to take place, which extension (13) moves sideways and downwards with respect to said safety when in the firing position, allowing it to swing.

3. A safety device for rifle triggers, as in claim 1, characterised in that the articulated plate (1) is provided, preferably at its end area close to the knurl (5), with a pair of holes (16–16') which work with a retractable pin (17) that establishes through said holes two stable positions for the articulated plate (1) and consequently for the mechanism as a whole, namely a safety and a firing position.

* * * * *